US008291960B2

(12) United States Patent
Bowman

(10) Patent No.: US 8,291,960 B2
(45) Date of Patent: Oct. 23, 2012

(54) PIVOTING BOTTOM BAR FOR ROLL-UP DOOR

(75) Inventor: Russell Bowman, Oro Station (CA)

(73) Assignee: TNR Industrial Doors Inc.

( * ) Notice: Subject to any disclaimer, the term of this patent is extended or adjusted under 35 U.S.C. 154(b) by 126 days.

(21) Appl. No.: 12/760,933

(22) Filed: Apr. 15, 2010

(65) Prior Publication Data

US 2011/0253323 A1 Oct. 20, 2011

(51) Int. Cl.
*E06B 9/56* (2006.01)

(52) U.S. Cl. ..... 160/267.1; 160/271

(58) Field of Classification Search ..... 160/267.1, 160/270, 271, 273.1, 274; 49/204, 205; 16/374, 16/377
See application file for complete search history.

(56) References Cited

U.S. PATENT DOCUMENTS 5,271,448 A * 12/1993 Delgado ..... 160/265
5,657,805 A 8/1997 Magro
5,765,622 A 6/1998 Lichy
5,829,504 A 11/1998 Ekstrand et al.
5,839,493 A 11/1998 Quasius
5,934,353 A 8/1999 Buhr
5,964,270 A 10/1999 Kirkey et al.
6,018,847 A * 2/2000 Lu ..... 16/337
6,035,918 A * 3/2000 Kraeutler ..... 160/84.06
6,053,237 A 4/2000 Bertilsson et al.
6,068,040 A 5/2000 Magro et al.
6,260,601 B1 7/2001 Thomas
6,431,250 B2 8/2002 Mullet et al.
6,901,703 B2 * 6/2005 Langenbach ..... 49/197
6,942,003 B2 * 9/2005 Thompson ..... 160/268.1
7,131,481 B2 11/2006 Varley et al.
7,516,770 B2 4/2009 Jerry
2011/0253323 A1 * 10/2011 Bowman ..... 160/309

* cited by examiner

*Primary Examiner* — Blair M. Johnson
(74) *Attorney, Agent, or Firm* — Gifford, Krass, Sprinkle, Anderson & Citkowski, P.C.

(57) ABSTRACT

A bottom bar apparatus for a door curtain includes a bottom bar mountable on a lower end of the curtain and two bar connectors for slidably connecting opposite ends of the bar to guide members mounted along sides of the door opening. The apparatus includes two pivot mechanisms each joining a respective one of the bar connectors to a respective end of the bar. Each mechanism includes a pivot shaft and a shaft receiver into which the shaft extends. One of the shaft and the receiver is connected to a respective one of the bar connectors and the other is mounted on the bottom bar. At least one stop device is arranged to limit pivotal movement of the bar and each is mounted on one of the group consisting of the pivot mechanism and the bar connector. Pivotal movement of the shaft is restricted when the curtain is subject to windload.

19 Claims, 9 Drawing Sheets

PIVOTING BOTTOM BAR FOR ROLL-UP DOOR

BACKGROUND OF THE INVENTION

This invention relates to roll-up doors of the type employing flexible sheets forming curtains for closing doorways and, in particular, to bottom bar apparatus for roll-up doors which are mountable on the lower ends of the door curtains.

It is well known in the industrial and commercial door industry to provide a flexible roll-up door that can be used to provide a passageway barrier in various types of facilities to accommodate the access of trucks, forklifts and other equipment to a facility or building or to provide passageway barriers within the facility or building. A flexible roll-up door typically consists of a synthetic rubber or fabric curtain which acts as a barrier across the passageway and which is attached across its top edge to a rigid steel pipe spanning the width of the passageway. This pipe is known as a drive barrel and it forms part of a curtain winding mechanism capable of raising or lowering the roll-up door as required.

It is also known to fit the lower end of the door curtain with some form of bottom bar which provides rigidity to the bottom edge of a door that makes contact with the ground. It is known that this bottom bar must be of sufficient rigidity to maintain adequate straightness of the curtain for the operation of the door. Also the bar is configured to have an adequate weight or mass to provide sufficient gravitational force to pull the curtain to the ground. It is also known to provide this bottom bar with reversing, safety and/or sealing devices.

Recent U.S. Pat. No. 7,516,770 issued Apr. 14, 2009 to TNR Industrial Doors Inc. describes a roll-up door assembly that includes a flexible curtain which can be made of synthetic rubber or fabric, a curtain winding mechanism and two guide members which extend vertically on opposite sides of the doorway. Opposite side edge sections of the curtain are movable in respective guide members. Each guide has inner and outer wall sections with each wall section having an inwardly projecting, longitudinal rib. The two ribs of each guide form an elongate slot that receives a side edge section of the curtain and spaced-apart pairs of curtain lock members are mounted on and distributed along each side edge section of the curtain. These lock members act to hold the side edges of the curtain within their respective guides but in a releasable manner. This known roll-up door is also provided with a bottom bar made with a couple of steel angle members that are secured to a bottom edge section of the curtain by means of bolts. The bar itself does not extend into the metal guide members for the door but plastic arms can be fastened to the ends of the bottom bar so as to extend into the guide members.

U.S. Pat. No. 5,765,622 issued Jun. 16, 1998 to Thruways Doorsystems Inc. describes a so-called damage minimizing roll-up door made with a continuous flexible curtain that has a bottom bar mounted along its lower edge. The bottom bar is releasably connected to guide structures mounted on opposite sides of the door opening. The bottom bar is constructed of two bar portions located on opposite faces of the curtain and secured to each other by bolts. The outer bottom bar portion has a notch formed therein and a retainer is affixed in this notch. The retainer is defined by a clip that includes a base web fastened to the outer bottom bar portion. The clip includes a pair of retaining clip arms which are flexible and biased. Each clip arm has a profile portion that is arcuate to accommodate a retaining tube sized to receive a roller shaft on which a roller is mounted. This roller is movable up and down in a roller guideway. The retainer of this patent is designed so that an impact force on the curtain will result in the bottom bar releasing or breaking away from the rollers located at its opposite ends.

There is a need for an improved bottom bar apparatus for a roll-up door made with a flexible sheet that forms a curtain which can be constructed at a reasonable cost and which better enables the roll-up door to withstand windloads on one side of a door curtain or air pressure on one side of the curtain that is greater than the air pressure on the opposite side.

SUMMARY OF THE DISCLOSURE

According to one aspect of the present disclosure, a bottom bar apparatus is provided for a roll-up door curtain having an upper end attachable to a curtain winding mechanism, a lower end and two side edges, this door curtain being mountable at a door opening having two opposite vertical sides. The bottom bar apparatus includes an elongate bottom bar mountable on the lower end of the door curtain so as to extend at least most of the length of the lower end and two bar connectors for slidably connecting opposite ends of the bottom bar to respective elongate guide members mountable along the opposite vertical sides of the door opening when the door curtain is installed. The apparatus further includes two pivot mechanisms each pivotally joining a respective one of the bar connectors to a respective one of the ends of the bottom bar. Each pivot mechanism includes a pivot shaft having a central pivot axis and a shaft receiver into which the pivot shaft extends. Each pivot shaft is pivotal in its shaft receiver about its central pivot axis. One of each pivot shaft and its shaft receiver is connected to a respective one of the bar connectors and the other of each pivot shaft and its shaft receiver is mounted on the bottom bar. There is at least one stop device arranged to limit pivotal movement of the bottom bar. The or each stop device includes a stop member mounted on one of the group consisting of its respective pivot mechanism and the adjacent bar connector so as to restrict pivotal movement of its pivot shaft relative to its shaft receiver during use of the roll-up door curtain when the curtain is subject to windload or greater air pressure on one side of the curtain compared to the other side of the curtain.

In one exemplary version of this bottom bar apparatus, there are two stop devices and the stop member of each stop device is a bolt mounted on a respective one of the pivot mechanisms and extends into a slot formed in the shaft receiver of the respective one pivot mechanism.

According to another aspect of the disclosure, there is provided a roll-up door including a flexible sheet forming a curtain for closing a doorway having an upper end, a lower end, and two opposite side edges. The sheet has a wind lock arrangement located along two side edge sections thereof. The door has a curtain winding mechanism having the upper end attached thereto for raising and lowering the curtain and a pair of spaced apart elongate guide members in which the edge sections are respectively movable. The side edge sections are respectively engageable with the guide members. The door includes a rigid bottom bar mounted on the lower end of the curtain and two bar connectors for connecting opposite ends of the bottom bar to the guide members. Each bar connector is located horizontally outwardly from a respective one of the ends of the bottom bar and is adapted to move up or down in its respective guide member and to be held therein. Two pivot mechanisms each pivotably join a respective one of the bar connectors to the adjacent end of the bottom bar. Each pivot mechanism includes a pivot shaft member having a central pivot axis and a shaft receiver into which the pivot shaft extends and in which the pivot shaft can pivot about its central pivot axis relative to the shaft receiver. One of the pivot shaft member and the shaft receiver is connected to its respective one of the bar connectors and the other of the pivot shaft member and the shaft receiver is mounted on the bottom bar. A stop member is mounted on one of the adjacent pivot mechanisms or one of the bar connectors for limiting pivotal movement of the adjacent pivot shaft relative to its shaft receiver during use of the roll-up door when the curtain is subject to windload or greater air pressure on one side of the curtain compared to the other side of the curtain.

In one exemplary version of this roll-up door, each bar connector includes a metal plate for slidably engaging a respective one of the guide members and two step members and two stop members mounted on opposite sides of the metal plate. The shaft receiver is rigidly mounted on or at an inner edge of the metal plate.

According to a further aspect of the present disclosure, there is provided a bottom bar apparatus for a roll-up door curtain having opposite upper and lower ends and two opposite side edges, the door curtain being mountable at a door opening having two opposite vertical sides along which extend respective elongate door guide units. The bottom bar apparatus includes an elongate bottom bar mountable on the lower end of the door curtain and two bar connectors for slidably connecting opposite ends of the bottom bar to the guide units. Each bar connector includes a metal plate and two elongate connector strips mounted on opposite sides of the metal plate and extending in a direction substantially perpendicular to the bottom bar. The apparatus further includes two pivot mechanisms, each pivotably joining a respective one of the bar connectors to a respective one of the ends of the bottom bar. Each pivot mechanism includes a pivot shaft connected to one of a group consisting of the bottom bar and a respective one of the bar connectors and a shaft receiver into which the pivot shaft extends. The shaft receiver is mounted on the other of the group consisting of the bottom bar and a respective one of the bar connectors. Each pivot mechanism includes at least one stop device to limit pivotal movement of the bottom bar. The or each stop device includes a stop member mounted on the respective pivot shaft and a cooperating slot into which the stop member extends. The slot is formed in the respective shaft receiver.

In one exemplary version of this bottom bar apparatus, the bottom bar is an elongate tube and each pivot shaft is rigidly connected at one end thereof to a mounting plate fixedly attached to an adjacent end of the bottom bar.

These and other aspects of the disclosed bottom bar apparatus and roll-up doors with bottom bar apparatus will become more readily apparent to those having ordinary skill in the art from the following detailed description taken in conjunction with the accompanying drawings.

BRIEF DESCRIPTION OF THE DRAWINGS

So that those having ordinary skill in the art to which the present disclosure pertains will more readily understand how to make and use the subject invention, exemplary embodiments thereof will be described in detailed herein below with reference to the drawings, wherein.

DETAILED DESCRIPTION OF EXEMPLARY EMBODIMENT

Figure 1:
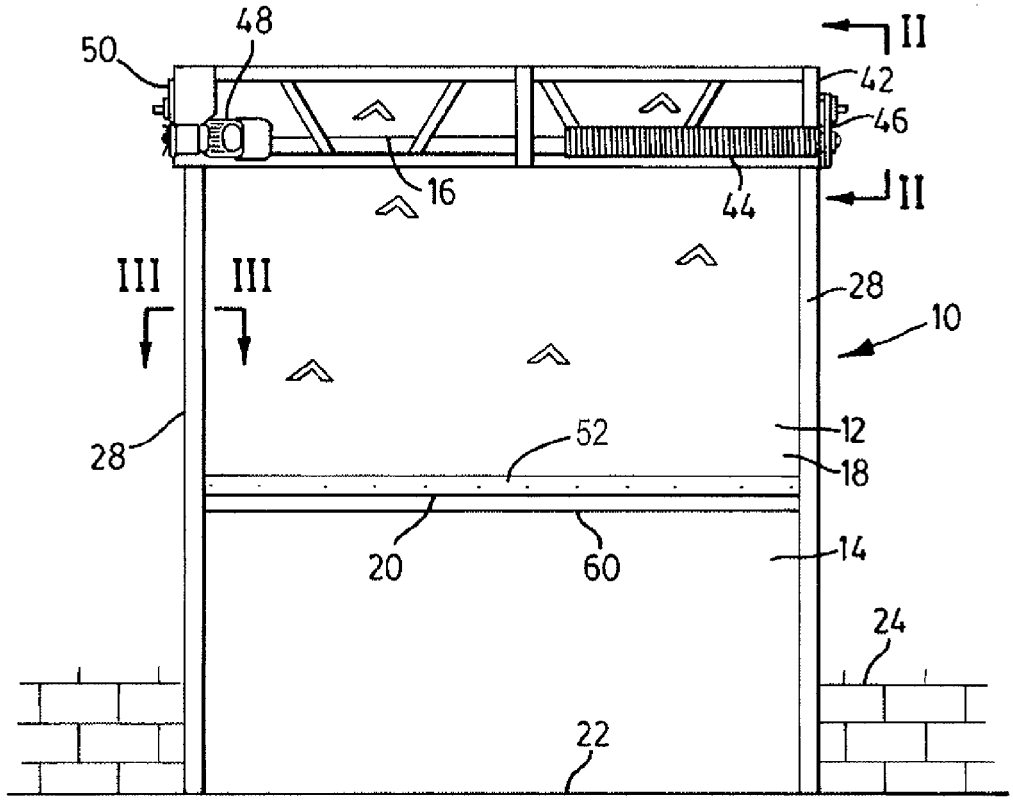
FIG. 1 (PRIOR ART)
FIG. 1 is an elevational view of a known form of flexible, roll-up door.
Figure 2:
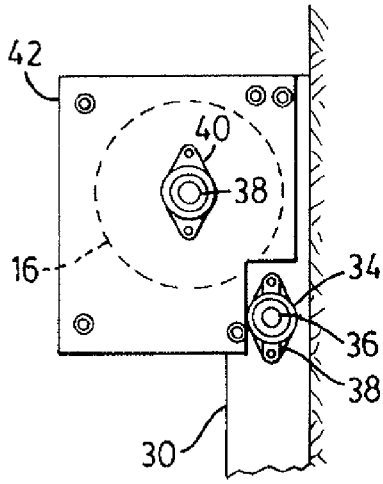
FIG. 2 (PRIOR ART)
FIG. 2 is a detail end view on a scale of approximately three times the scale of FIG. 1, this view being taken along the line II-II of FIG. 1 and illustrating the position and attachment of some door components positioned at the top of the door opening.
Figure 3:
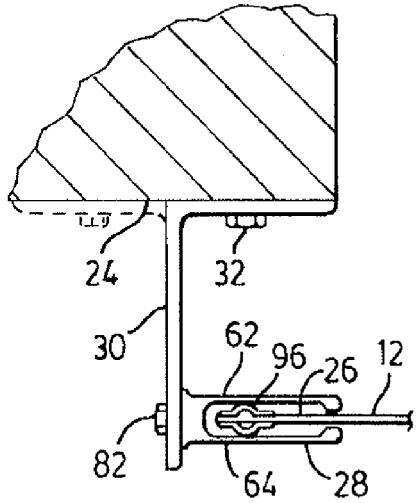
FIG. 3 (PRIOR ART)
FIG. 3 is a horizontal cross-sectional detail view along section line III-III of FIG. 1 illustrating a known door guide and a mounting angle for the door guide on which the latter is mounted.
Figure 4:
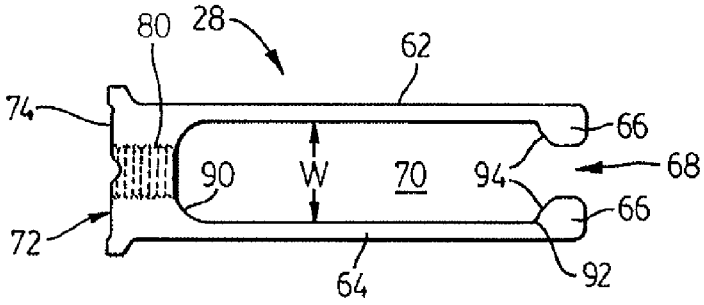
FIG. 4 (PRIOR ART)
FIG. 4 is an enlarged end view of one door guide for the roll-up door curtain of FIG. 1.

FIGS. 1 to 5 illustrate a prior art flexible, roll-up door constructed in, accordance with the teachings of U.S. Pat. No. 7,516,770, the description and drawings of which are incorporated herein by reference. The illustrated roll-up door assembly includes a flexible curtain 12 which can be made of rubber, synthetic rubber or fabric material and which is capable of closing a doorway 14. The curtain has an upper end mechanically fastened to a drive barrel 16 and also a lower end 18 mechanically fastened to a rigid bottom bar 20. The curtain is able to completely cover the doorway when the bottom bar is lowered to the ground or floor 22. The doorway is formed by a wall 24, only a portion of which is shown. The curtain can be wound up or lowered by the barrel 16 which is part of a curtain winding mechanism. Vertical side edge sections 26 of the curtain are movably mounted in two straight, extruded guide members 28 which can be made of flexible metal, preferably aluminum alloy. The two guide members extend along the two vertical sides of the doorway 14 and they are each mechanically fastened to a mounting angle 30, the cross-section of which is shown in FIG. 3. The mounting angle is secured in an appropriate manner to the wall 24 of the structure. The mounting angle on each side can be secured to the wall by fasteners 32, such as bolts, distributed along its length. Other forms of frame means for mounting the guide members can also be used.

Illustrated in FIG. 2 is an idler barrel 34 which is located above the top of the doorway 14 and is secured by end caps 36 to the mounting angle 30 by means of flange type bearings 38 secured to the mounting flange. Each of the two ends of the drive barrel 16 is supported by a steel shaft mounted in and supported by flange type bearings 40. These bearings are mounted by suitable fasteners to respective end plates 42, which in turn can be secured to respective adjacent mounting angles 30. The illustrated roll up type door is counter-balanced by use of a torsion spring 44 using a chain drive 46 which is connected to the drive barrel. There are various known substitutes for the torsion spring. The roll-up door can be powered by an electric motor and gear box operator 48 which uses a chain drive at 50, which is also connected to the drive barrel 16.

Figure 6:
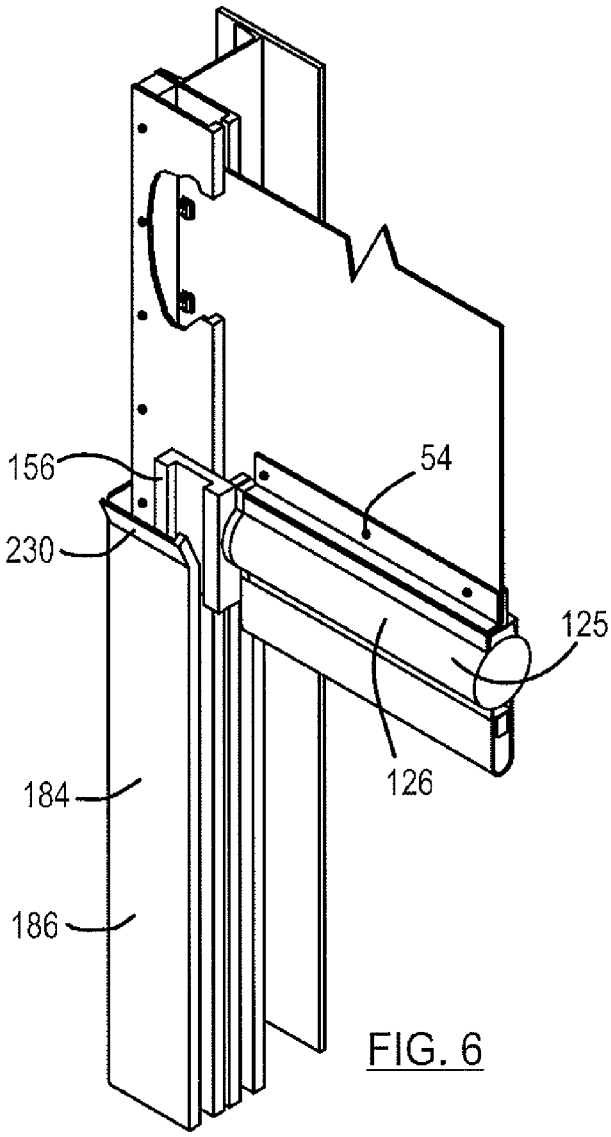
FIG. 6 is a partial isometric view showing a bottom section of a door curtain, a portion of a bottom bar apparatus constructed according to the present disclosure and a guide system for the curtain and bottom bar apparatus.

FIG. 1 illustrates a prior art bottom bar 20 attached to the lower end of the door curtain and FIG. 6 illustrates a portion of a bottom bar apparatus 125 constructed in accordance with the present disclosure. The known bottom bar of FIG. 1 comprises a couple of steel angle members 52 mounted on opposite sides of the lower end of the curtain. Both the known bottom bar and the bottom bar apparatus of FIG. 6 are secured to the curtain using bolts 54. Note that the ends of the known bottom bar 20 do not extend into the metal guide members 28 but only extend between the two guide members.

The known guide member 28 for each curtain edge can be formed of integrally connected inner and outer, longitudinally extending wall sections 62, 64. Each of these wall sections is generally planar and each has an inwardly projecting, longitudinally extending rib 66. The two ribs 66 of each guide member form an elongate slot 68 through which a respective one of the side edge sections of the curtain extends during use of the door assembly as shown in FIG. 3. A cavity 70 is formed between the wall sections and is adapted to slidably receive the side edge section of the curtain. A base section 72 is integrally connected to and joins the inner and outer wall sections of the guide member. The base section forms an end wall 74 suitable for mounting the guide member on the mounting angle 30. A series of spaced apart threaded holes 80 are used to mount the guide member on the mounting angle by means of bolts 82.

Figure 5:
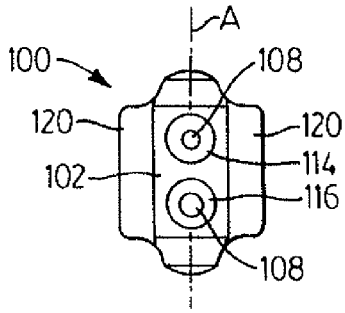
FIG. 5 (PRIOR ART)
FIG. 5 is an enlarged detail view of one side of a known curtain lock member.

The slot 68 formed by the two ribs is substantially narrower than the maximum width W of the cavity as measured between the two wall sections. The exemplary ribs 66 shown each have an interior surface 94 which is elongate and concave as seen in transverse cross-section. The two concave surfaces of the ribs form an elongate split, curved socket for directly engaging curtain locks distributed along the side edge section of the curtain. The lock mechanism for each side edge section of the door curtain comprises spaced apart pairs of curtain lock members mounted on and distributed along each side edge section of the curtain. One form of lock member 100 is illustrated in FIG. 5 and two back-to-back lock members can be seen in FIG. 3. The lock members of each pair in an exemplary version of the door curtain are positioned directly opposite one another on the front end rear surfaces of the curtain 12. The combined thickness of each pair of lock members and the curtain material exceeds the width of the elongate slot 68 so that the pairs of lock members prevent the side edge sections of the curtain from escaping out of the guide members under normal windload or pressure conditions. At least some, if not the majority, of the curtain lock members 100 engage with the ribs 66 of their respective guide members when an excessive windload or impact is put upon the curtain 12 and this engagement can cause the wall sections of at least one guide member to separate from each other and thereby release the respective side edge section (or part thereof) from the guide member with little, if any, damage to the curtain or the guide members.

The lock member 100 illustrated in FIG. 5 is mounted on its side edge section of the curtain so that its longitudinal axis indicated at A is substantially parallel to the adjacent side edge of the curtain. The back-to-back lock members can be connected to each other by means of machine screws that extend through the two holes 108. The machine screws are concealed within counter bores 114, 116 formed in the lock members. Each lock member can be formed with at least one substantially flat wing section 120 integrally connected to a longitudinal side of the main body section 102. In illustrated lock member 100, there are two of these wing sections 120, each extending from its respective longitudinal side of the main body section. At least one of these wing sections is adapted to extend through or into the elongate slot 68 formed in the respective door guide during use of the curtain lock.

Figure 7:
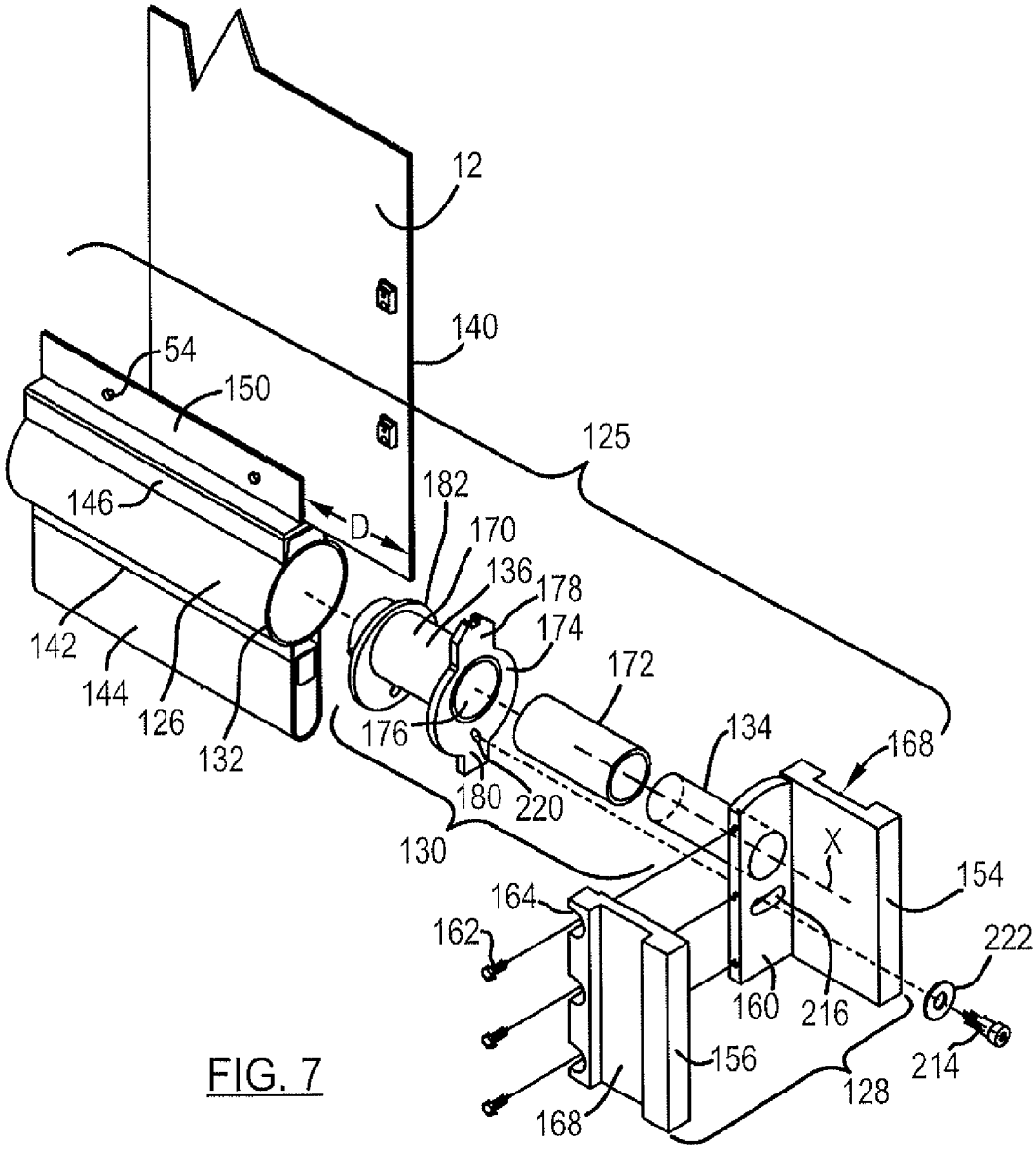
FIG. 7 is an isometric exploded view showing components of a bottom bar apparatus of the present disclosure with only one end section of the bar itself being shown.

Turning now to a first embodiment of a bottom bar apparatus 125 of the present disclosure, the major components of this apparatus include a rigid, bottom bar 126, only an end section of which can be seen in FIG. 7, two bar connectors 128 for connecting opposite ends of the bottom bar to the guide channel systems for the door and two pivot mechanisms indicated generally at 130. Each bar connector 128 is located horizontally outwardly from a respective one of the ends 132 of the bottom bar and it is adapted to move up or down in its respective guide channel system and to be held therein. Each pivot mechanism 130 pivotally joins a respective one of the bar connectors 128 to the adjacent end of the bottom bar. Each pivot mechanism includes a pivot shaft 134 having an outer end connected to its respective bar connector and a central pivot axis indicated by the dash line X in FIG. 7. Each pivot mechanism also includes a shaft support indicated generally at 136. The shaft support is mounted on the bottom bar 126 and, in the illustrated embodiment in which the bottom bar is a hollow tube, the shaft support is mounted in the hollow end section of the bottom bar. It will be understood that each pivot shaft is pivotal in the shaft support about its central pivot axis X.

The illustrated bottom bar 126 is a metal tube which can be made of steel, for example. The bar extends at least most of the width of the door curtain 12 but, at each end, it terminates short of the adjacent side edge 140 of the curtain by a suitable distance such as the distance D indicated in FIG. 7. In this way, the bottom bar does not interfere with the aforementioned guide member 28 into which the side edge section of the curtain extends. An elongate channel 142 can be welded to the bottom of the tube to facilitate mounting a reversing edge and rubber loop indicated at 144. Another elongate channel 146 can be welded to the top of the tube to facilitate attaching the curtain 12. It will be understood that these channels add to the strength of the tube, reducing the amount that the bottom bar will deflect under windload conditions. The upper channel 146 can be connected to the bottom edge section of the curtain by means of two elongate angle members 150, only one of which is shown in FIG. 7. Both of the angle members can be seen in FIGS. 9 and 11. These angle members are located on opposite sides of the curtain and, as indicated, they are connected to the curtain by a series of bolts 54.

The bar connector shown is a plate arrangement for slidably engaging a respective one of the guide channel systems indicated generally at 152 in FIGS. 8 to 11. In the illustrated plate arrangement, there are two spaced-apart channel members 154, 156, each of which can be formed from a steel plate. The inner surfaces of these channel members are parallel and they are joined together by a plate connector 160. This plate connector extends between and rigidly joins the two channel members and one end of the pivot shaft 134 can be connected rigidly to one side of the connector, that is, the side facing the bottom bar. Although two channel members are provided on the illustrated bar connector, it is possible for the bar connector to have only one channel member moveable in a single guide slot. Each channel member 154, 156 can be detachably connected to the plate connector by means of three high-strength bolts 162, which are threaded into holes formed in the side edge of the plate connector. An edge section of each channel member can be formed with three recesses 164 (or counter bores) to accommodate the heads of the bolts. The channel members can also be referred to as connecting arms. Each arm or channel member is made of a steel plate with a layer of polyurethane molded to the outside and covering the walls of each vertical channel 168. The layer of polyurethane helps to reduce friction between the channel member or arm and the side of the guide channel in which it moves, particularly an elongate stop member provided along the edge of the guide channel.

Turning now to the construction of the illustrated shaft support 136, which is constructed to fit inside the end of the hollow, tubular bottom bar 126, the shaft support (which can also be termed a bar plug) includes a tubular sleeve section 170 which can be open-ended and forms a longitudinal passage adapted to receive a cylindrical bushing 172 which can, for example, be made of ultra-high molecular weight PE that can extend the length of the passage. The internal diameter of the bushing corresponds closely to the diameter of the pivot shaft 134, which slides into the bushing. In addition to the sleeve section 170, the shaft support further includes a connecting plate 174 which is formed with a circular opening 176 having a diameter equal to the external diameter of the sleeve section. Thus an end portion of the sleeve section can fit into this opening and can be welded therein or otherwise rigidly attached. The plate 174 has a circular central section with a diameter corresponding to the diameter of the bottom bar, a relatively large upward extension 178 and smaller downward extension 180. The upward extension covers the end of the channel 146, while the downward extension covers the end of the lower channel 172 of the bottom bar.

To provide further support for the sleeve section 170, there can be a second, circular plate 182 mounted on the sleeve section and spaced most of the length of the sleeve section from the connecting plate 174. The plate 182 is formed with a circular opening through which the sleeve section extends and the diameter of the plate corresponds to the internal diameter of the passage in the bottom bar 126.

One form of the two guide channel systems 152 for the roll-up door curtain of FIG. 6 will now be described in further detail. In addition to being provided with the flexible, resilient guide member 28 (or a variation thereof) into which an edge section of the curtain extends, each guide system includes an elongate so-called guide guard 184 that, in the illustrated version, is formed by a resilient, metal angle member. This angle member has a front leg 186 that extends over the front of the centrally located guide member 28 but is spaced therefrom and a side leg 188 that can be attached by a series of bolts or screws to the base of the guide member. A portion of one of the channel members is slidable in the slot formed between the front leg 186 and the guide member 28. A rear guide guard 190 is also provided for the guide channel system and this guide guard can have the same length as the front guide guard and can extend downwardly to the floor or the ground at the door opening. The rear guide guard has an inwardly extending leg 192 which is spaced from the guide member 28 and a rearwardly extending leg 194. The rear guide guard can be rigidly attached to a vertically extending channel member 196, such as by welding. It will be understood that the channel member 196 forms part of the door frame and it can be rigidly attached to a steel support plate 198, such as by welding. The plate 198 is rigidly connected in a suitable manner to the adjacent wall 200 of the structure. It will also be noted that the base of the guide member 28 is detachably connected to the front facing wall 202 of the channel member. Again, bolts or screws can be used to attach the base of the guide member 28.

Provided on each of the front guide guard 184 and the rear guide guard 190 is a longitudinally extending elongate stop that can extend substantially the length of the guide guard. The front guide guard 184 has a stop 204 extending along the inner edge of its front leg so as to project towards the adjacent guide member 28. The rear guide guard has its stop 206 extending along the inner edge of the inwardly extending leg 192 and projecting towards the guide member 28. The stops 204 and 206 prevent their respective channel members 154, 156 from escaping from their respective guide channels of the guide channel system.

FIG. 6 is a partial view that illustrates the bottom bar 126 in a raised position. The position illustrated in FIG. 6 has the bottom bar located approximately 8 feet above the floor (not shown). At this height, the channel members 154, 156 are just entering the guide guards which have tapered throat sections at 230. When the bottom bar is at this height and assuming safe operating windloads, the wind does not catch enough of the curtain to cause any significant sailing. Thus, in this position, the curtain is generally relaxed and the bottom bar is straight.

Figure 8:
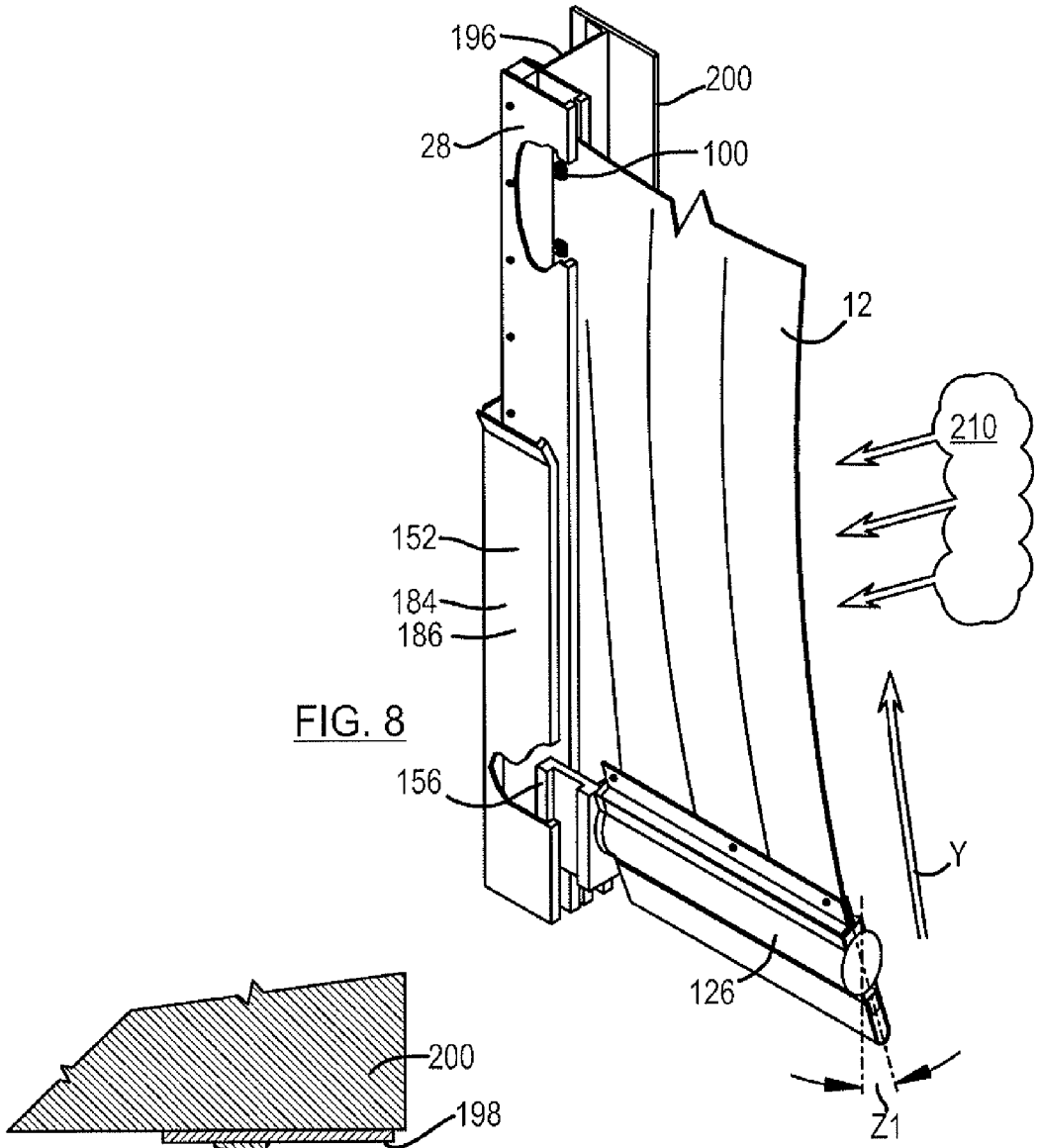
FIG. 8 is an isometric illustration showing the effect of windload on a roll-up door curtain.
Figure 9:
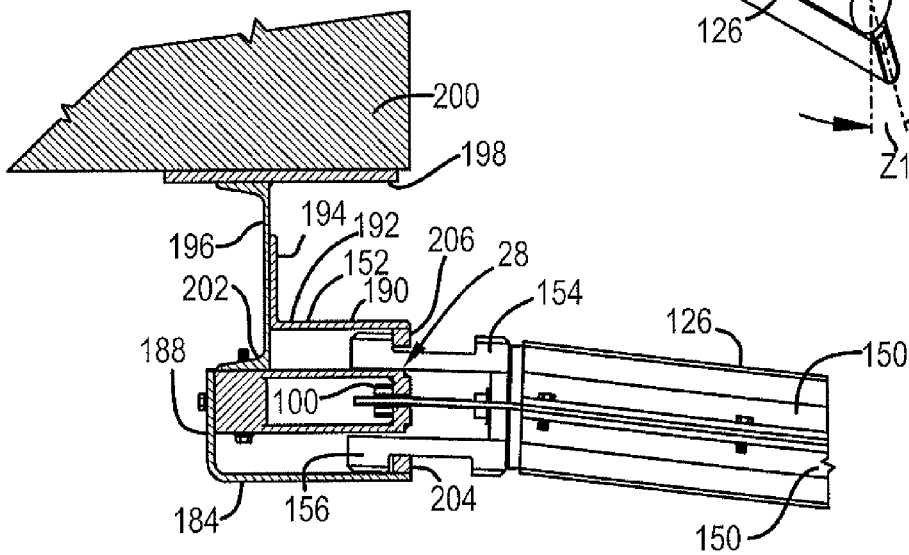
FIG. 9 is a horizontal cross-section showing the top of an end section of the bottom bar apparatus and the guide system at one end of this apparatus, this view also showing the effect of windload from behind the door curtain.

With particular reference to FIGS. 8 and 9, the bottom bar is located at the floor or ground and the roll up curtain is fully extended. These figures show the effect of a substantial windload indicated by the arrows 210 on the rear side of the curtain. The curtain is illustrated in full sail and the bottom bar 126 is deflected to its predetermined maximum distance. In this position, the curtain lock members 100 and the channel member 154, 156 are tight against their stops. The bottom bar 126 has compensated for this windload effect by pivoting about its central longitudinal axis towards the front of the door and this pivoting movement keeps the tension from the door curtain perpendicular to the bottom bar along its strongest axis. The tension in the curtain is indicated by the arrow Y in both FIGS. 8 and 10.

Figure 10:
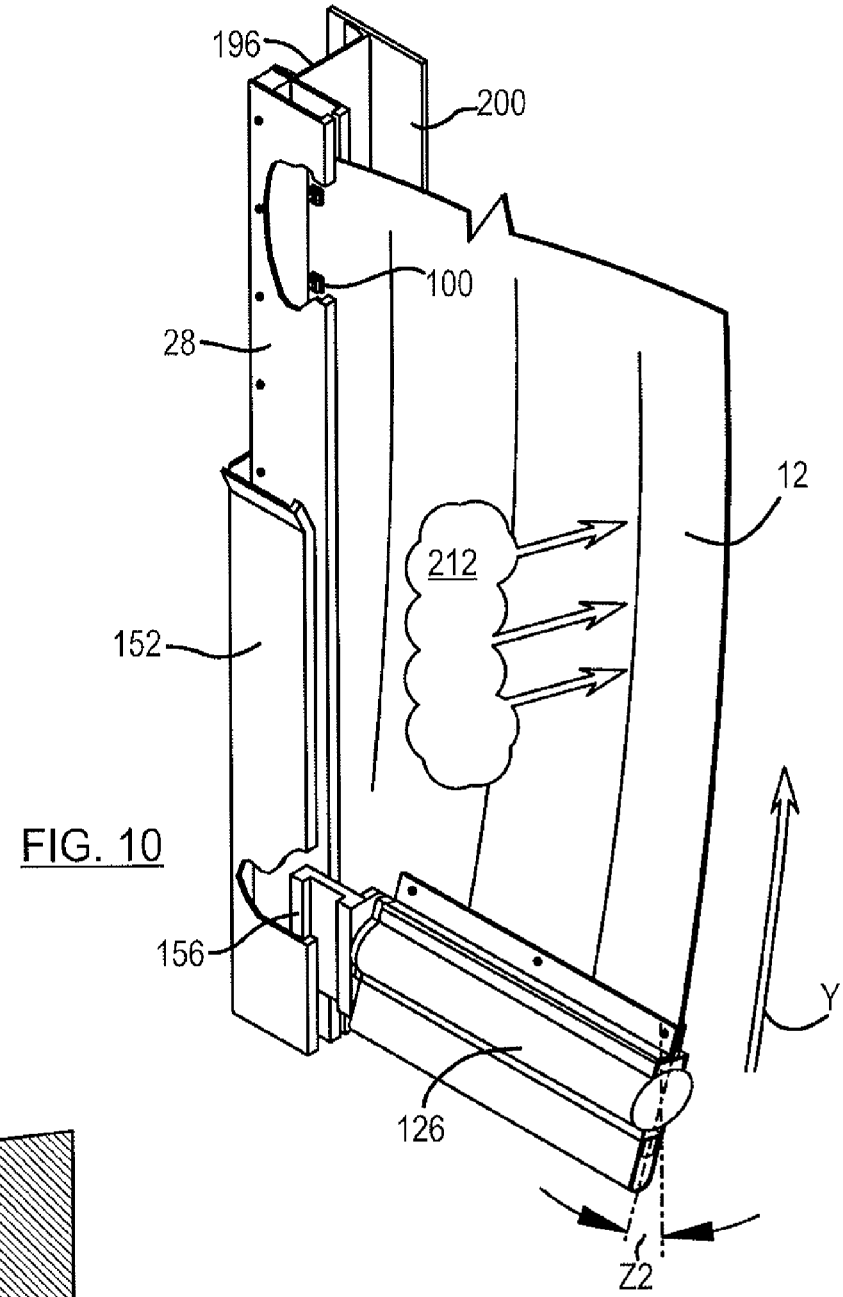
FIG. 10 is an isometric partial view of a portion of a door or curtain and its bottom bar, this illustration showing the effect of windload from the front of the door.
Figure 11:
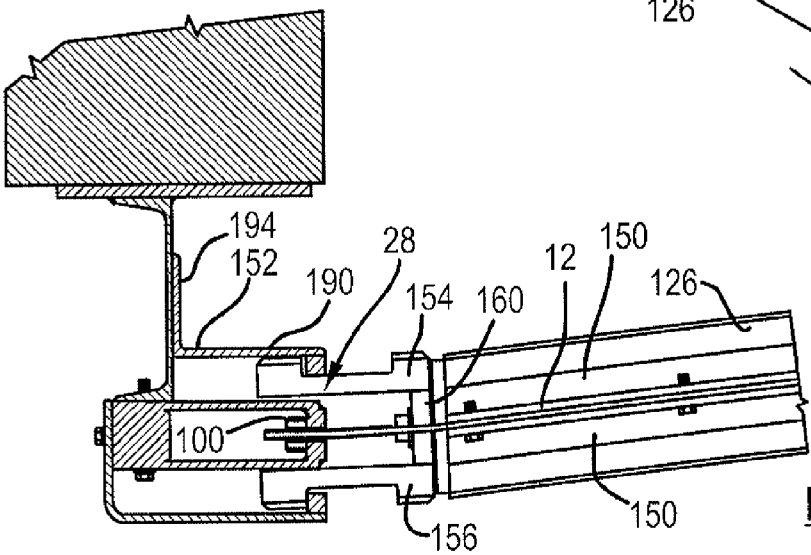
FIG. 11 is a horizontal cross-section similar to FIG. 9 but showing the effect of windload from the front of the door.

With reference to FIGS. 10 and 11, these figures again show the bottom bar 126 at the floor but, in these figures, the substantial windload indicated by the arrows 212 is from the front side of the door curtain. Again, the curtain is in full sail and the bottom bar has been deflected to its predetermined maximum distance. The curtain lock members 100 and the bottom bar channel members 154, 156 are tight against their stops. The bottom bar 126 has compensated for the windload by pivoting about its central longitudinal axis towards the back of the door, keeping the tension Y from the curtain perpendicular to the bottom bar along its strongest axis.

The first embodiment of the roll-up door is provided with a stop member 214 for limiting pivotal movement of the adjacent pivot shaft 134 relative to its shaft support 136 when the door curtain is subject to the aforementioned windload or greater air pressure on one side of the curtain compared to the other side of the curtain. In the roll-up door of FIG. 7, there are in fact two stop members 214, one at each end of the bottom bar. Each of these stop members is mounted on a respective one of the pivot mechanisms 130 and each stop member extends into an arcuate slot 216 formed in its respective plate connector 160 which is part of the bar connector. In order to attach each stop member, a threaded hole 220 can be formed in the connecting plate 174 and the stop member in the form of a bolt is threaded into this hole. A standard washer 222 can be provided between the bolt head and the plate connector 160. In an exemplary form of the roll-up door of the present disclosure, the stop members limit the pivotal movement of the adjacent pivot shaft 134 to about 15 degrees in either direction from a vertical plane, which can be defined by the two guide channel systems 152 when the roll-up door is installed in a door opening. The bolt forming each stop member 214 can be a shoulder bolt adequately sized to hold the bottom bar attached thereto in position and limit the amount of the pivotal motion thereof. The exemplary maximum pivot angle of 15 degrees is indicated at Z1 in FIG. 8 and at Z2 in FIG. 10.

It will be appreciated that instead of the illustrated stop arrangement, it is possible to mount the stop member 214 instead on the plate connector 160 (for example by means of a threaded hole formed in the plate connector) and to form the arcuate slot in the connecting plate 174 that is connected to the bottom bar. In other words, each stop member can be mounted either on its respective pivot mechanism 130 or on its respective bar connector which includes the connector plate 160.

Figure 12:
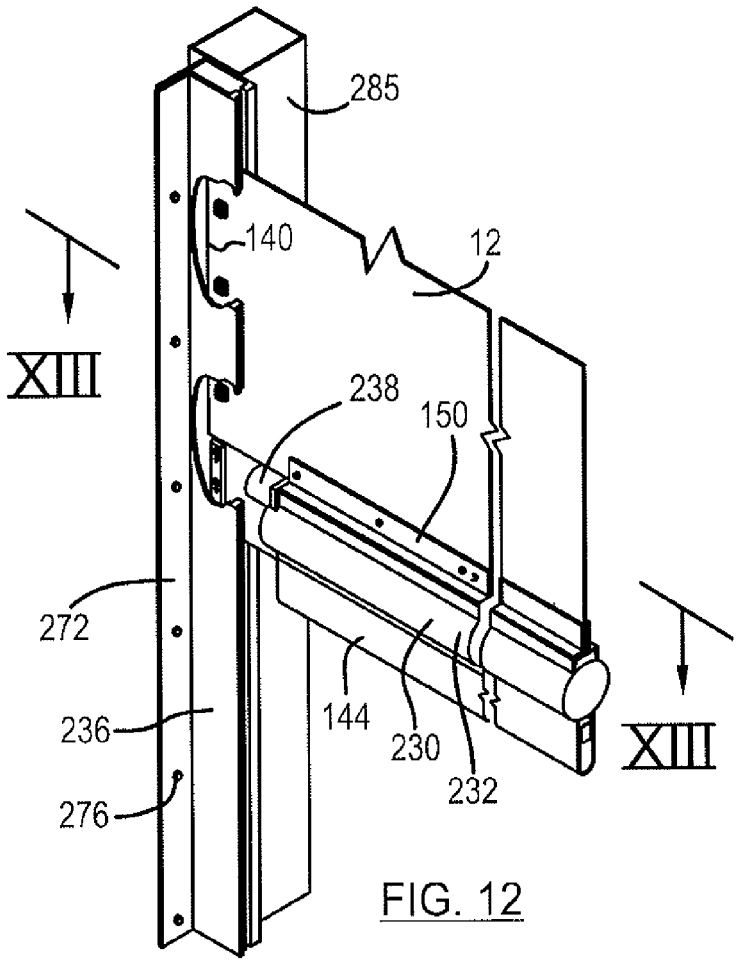
FIG. 12 is a partial isometric view similar to FIG. 6 but illustrating another embodiment of a bottom bar apparatus constructed according to the present disclosure mounted on a flexible door curtain.
Figure 13:
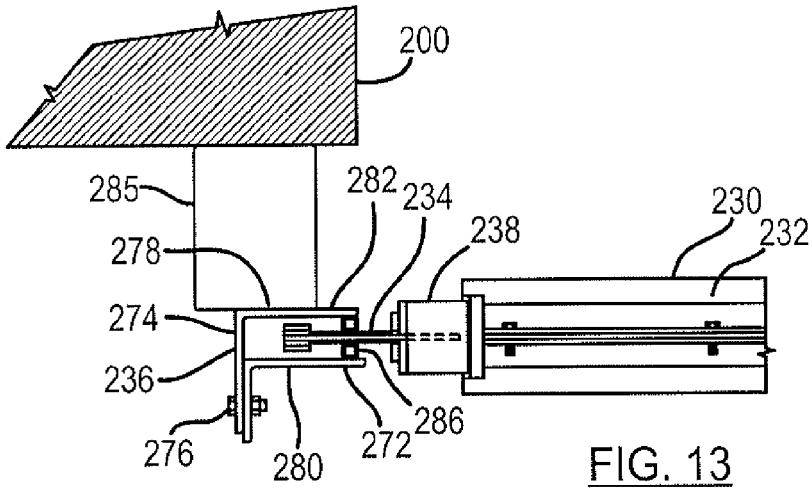
FIG. 13 is a horizontal cross-sectional view taken along the line XIII-XIII of FIG. 12.
Figure 14:
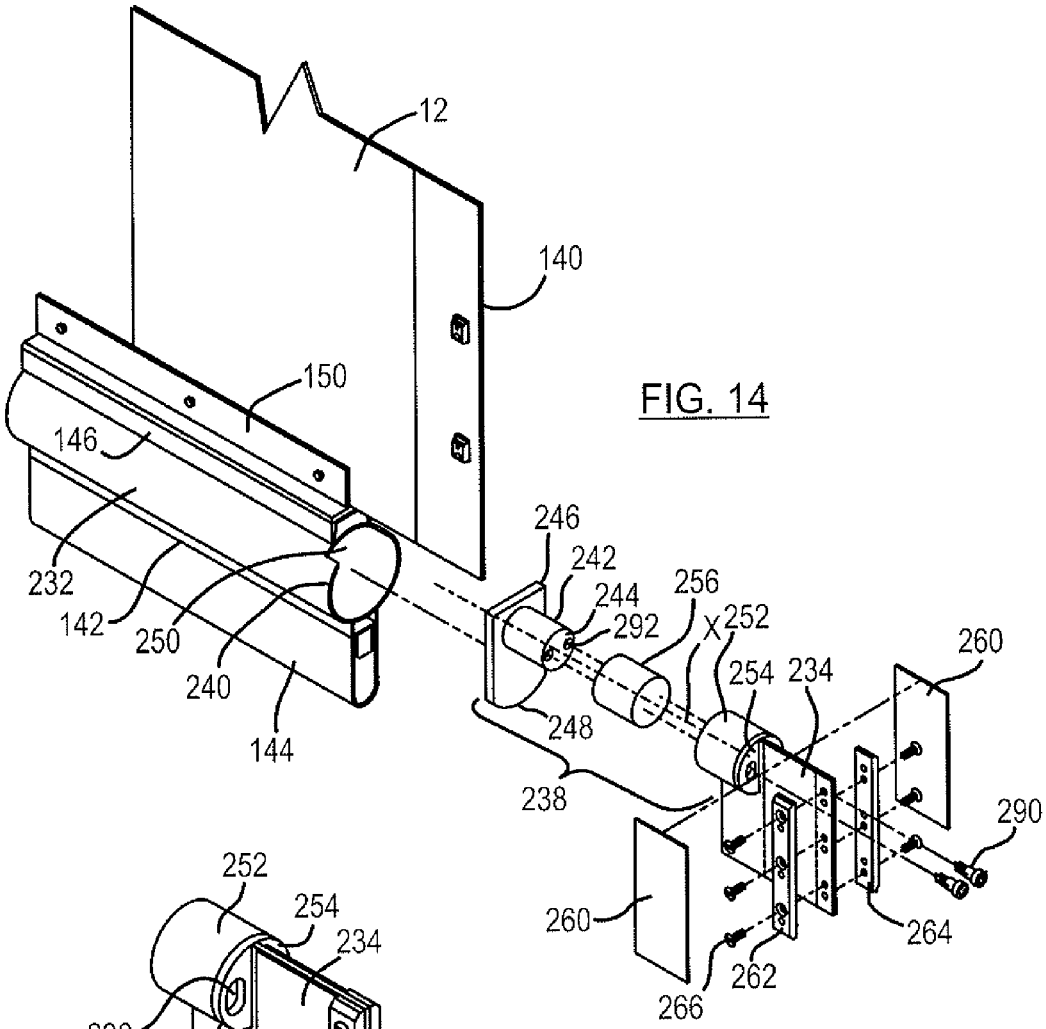
FIG. 14 is an isometric exploded view showing components of the embodiment of FIG. 12 with only one end section of the bottom bar being shown.

A second embodiment of a bottom bar apparatus of the present disclosure is illustrated in FIGS. 12 to 14. This embodiment is indicated generally by reference 230. The major components of this second embodiment include a rigid bottom bar 232, only an end section of which can be seen in FIGS. 12 and 14, two bar connectors 234 for connecting opposite ends of the bottom bar to elongate guide members 236 for the door, and two pivot mechanisms indicated generally at 238. Each bar connector 234 is located horizontally outwardly from a respective one of the ends 240 of the bottom bar and is adapted to move up or down in its respective guide member and to be held therein. Again each pivot mechanism 238 pivotably joins a respective one of the bar connectors 234 to the adjacent end of the bottom bar. Each pivot mechanism includes a pivot shaft 242 having an outer end 244 and an inner end connected to an end plate 246. The illustrated plate 246 has a straight, horizontal upper end and a curved bottom end 248. The flat end plate 246 is fitted into the adjacent end of the bottom bar tube and can be welded into place. The end of the shaft can be welded to the plate 246. A notch or cutout can be formed at 250 in the bottom bar to snugly receive the upper portion of the end plate. The pivot shaft has a central pivot axis indicated by the dash line X in FIG. 14. Each pivot mechanism also includes a shaft receiver 252 which can be constructed from a heavy wall tube and provided with a circular end plate 254. The end plate can be rigidly attached to the end of the tube by welding and the shaft receiver can be welded to its respective bar connector 234, which can also be referred to as a connecting arm. In this embodiment the connector or arm is made of a steel plate sized in thickness and in height to hold the flexible door curtain from blowing out under heavy windloads. Each pivot shaft 242 is pivotal in the shaft receiver 252 about its central pivot axis X. Extending around the pivot shaft is a bushing 256 which is made of a friction reducing material such as ultrahigh molecular weight PE. The bushing fits snugly inside the shaft receiver 252.

The bottom bar 232 extends at least most of the width of the door curtain 12. However at each end it terminates short of the adjacent side edge 140 by a suitable distance in order to accommodate the aforementioned pivot mechanism 238 and the bar connector 234. As in the first embodiment, an elongate channel 142 can be welded to the bottom of the tube in order to mount the reversing edge and rubber loop 144. An elongate channel 146 can be welded to the top of the tube to facilitate attaching the curtain. The upper channel is connected to the bottom edge section of the curtain by means of two elongate angle members 150. The two angle members are located on opposite sides of the curtain and are connected to the curtain by a series of bolts.

An exemplary form of the bar connector or arm 234 has two wear pads 260 mounted on opposite sides of the steel plate. In one version, these pads are $1/16^{th}$ inch thick ultrahigh molecular weight PE that has been laminated to $1/16^{th}$ inch thick Neoprene sheet. The pads can be attached to sides of the steel plate by gluing and it will be understood that these pads enable the bar connector to slide up and down in the guide member with minimum wear. Each bar connector is adapted not only to move up and down in its respective guide member but it is also adapted to be held in the guide member. In the illustrated version, each connector has two stop members 262, 264 which are mounted on opposite sides of the metal plate, preferably by means of bolts 266 which extend through holes in the stop members and thread into holes formed in the metal plate. Exemplary versions of the stop members are made of ultrahigh molecular weight PE and each is an elongate bar or strip. It will be appreciated that the combined thickness of the two stop members and the steel plate is greater than the width of the throat formed by each guide member 236 as can be seen in FIG. 13.

A corner cutout at 270 can be formed at the top of the inner edge section of the bar connector and in this cutout can be rigidly mounted the shaft receiver 252. The shaft receiver can be welded to the steel plate to connect same.

The guide members 236 will now be described with particular reference to FIGS. 12, 13 and 16. As indicated previously, the door curtain 12 has a windlock arrangement located along two side edge sections thereof and these side edge sections are respectively movable in the guide members 236 and are respectively engageable with the guide members. Each guide member 236 can be formed by two elongate metal angle members 272, 274. The two angle members are detachably connected together by means of a series of bolt and nut combinations 276. The angle members have two, parallel spaced apart legs 278, 280 that form a guide channel 282. Into this channel the adjacent side edge section of the door curtain extends as well as the adjacent bar connector. The angle member 274 can be rigidly connected to an upright beam or tubular frame member 285 which can be part of the door frame. The beam 285 can be rigidly mounted on or attached to the adjacent wall 200 of the structure. Provided on each of the two legs 278, 280 is a longitudinally extending, elongate stop 286. The stops 286 prevent their respective bar connector 234 from escaping from the guide channel of the guide member.

The partial view of FIG. 12 illustrates the bottom bar 232 in a raised position. If the door curtain has been sufficiently raised, then the wind will not catch enough of the curtain to cause any significant sailing. In this position, the curtain is generally relaxed and the bottom bar is straight as illustrated by FIGS. 12 and 13.

Figure 16:
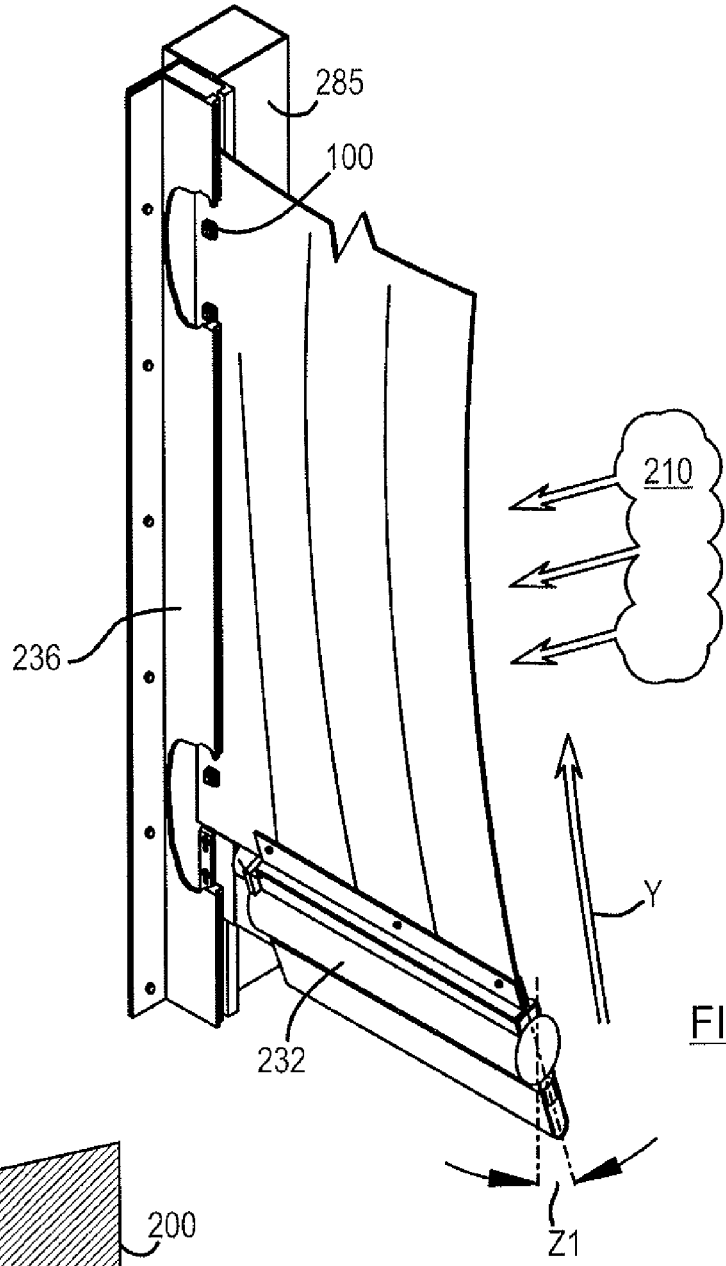
FIG. 16 is an isometric illustration showing the effect of windload on the roll-up door curtain of FIG. 12.
Figure 17:
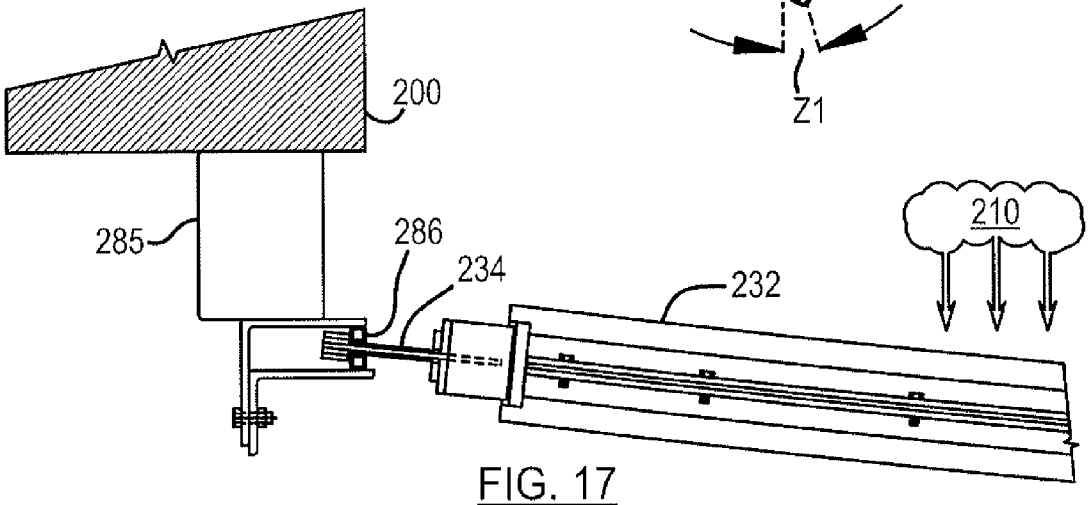
FIG. 17 is a horizontal cross-section similar to FIG. 13 but showing the effect of windload from behind the door curtain.

With reference to FIGS. 16 and 17, the bottom bar is located at the floor or ground and the roll-up curtain is fully extended. These figures show the effect of a substantial windload indicated by the arrows 210 on the rear side of the curtain. The curtain is illustrated in full sail and the bottom bar 232 is deflected to its predetermined maximum distance. The curtain lock members 100 and the bar connectors 234 are tight against their stops. The bottom bar 232 has compensated for the windload by pivoting about its central longitudinal axis towards the front of the door, thereby keeping the tension from the curtain perpendicular to the bottom bar along its strongest axis. The tension in the curtain 12 is indicated by the arrow Y in FIG. 16.

Figure 18:
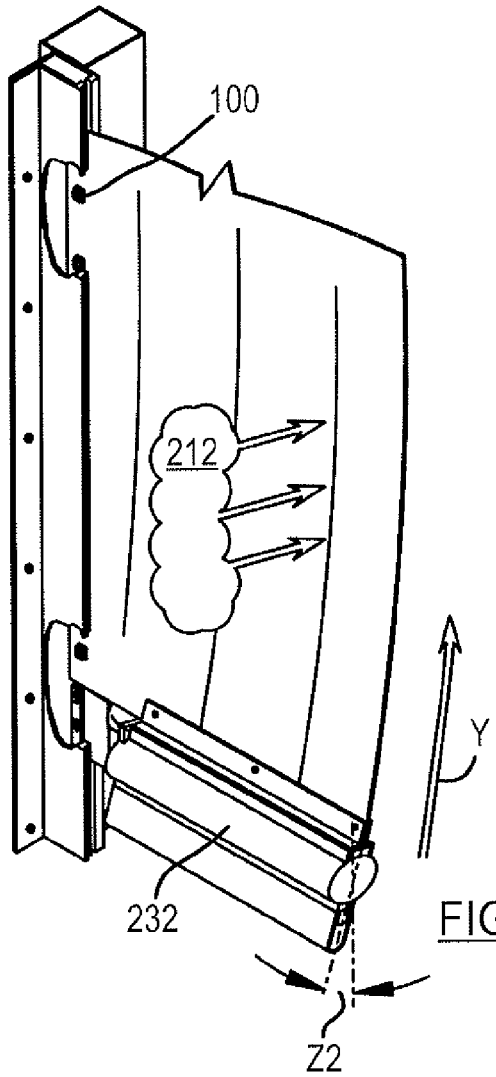
FIG. 18 is another isometric partial view of the door curtain and bottom bar of FIG. 12, this view illustrating the effect of windload from the front of the door.
Figure 19:
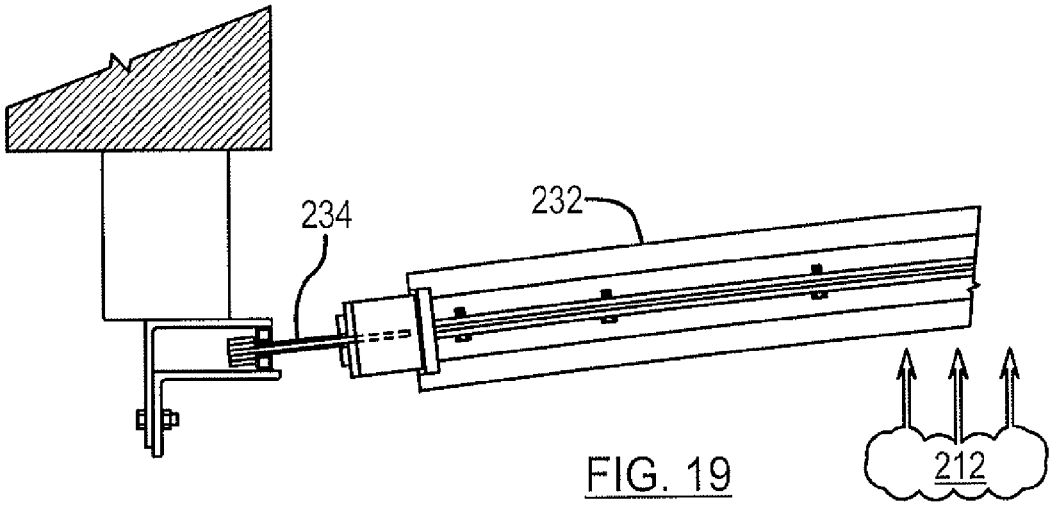
FIG. 19 is horizontal cross-section similar to FIGS. 13 and 17 but showing the effect of the windload from the front of the door.

With reference to FIGS. 18 and 19, these figures show the bottom bar 232 at the floor and show substantial windload indicated by arrows 212 applied to the front side of the door curtain. The bottom bar has been deflected to its predetermined maximum distance and the curtain lock members 100 and bar connectors 234 are tight against their stops. Again the bottom bar 232 has compensated for this windload by pivoting about its central longitudinal axis towards the back of the door, keeping the tension Y from the curtain perpendicular to the bottom bar along its strongest axis.

Figure 15:
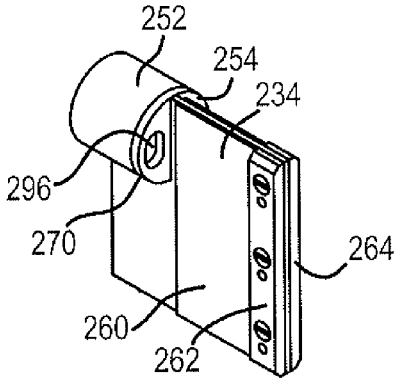
FIG. 15 is an isometric detail view of a shaft receiver and bar connector for the embodiment of FIGS. 12 to 14.

The second embodiment of the roll-up door as illustrated by FIGS. 12 to 14 is also provided with at least one stop member mounted on one of the pivot mechanisms for limiting pivotal movement of the adjacent pivot shaft relative to its shaft receiver during use of the roll-up door when the curtain is subject to windload or greater air pressure on one side of the curtain compared to the other side of the curtain. In the illustrated second embodiment there are two stop members in the form of bolts 290 at each end of the bottom bar. The exemplary bolts can be shoulder bolts adequately sized to hold the connectors on the ends of the bottom bar and to limit the amount of rotation to an exemplary amount, in particular 15 degrees in either direction. The two bolts are threaded into the outer end of their respective pivot shaft 242. They can be threaded into threaded bolt holes 292 located on diametrically opposite sides of the shaft. As can be clearly seen in FIG. 15, the end plate 254 of the shaft receiver is formed with two curved slots 296 through which extend the bolts 290. In this way it will be appreciated that the amount of pivotal movement of the pivot shaft in its respective receiver is limited by the length of the slots and the amount by which the bolts can move in the slots. The exemplary maximum pivot angle of 15 degrees is indicated at Z1 in FIG. 16 and at Z2 in FIG. 18.

It will be appreciated that instead of the illustrated pivot mechanism shown in FIGS. 12 to 14, it is possible to mount the pivot shaft on the bar connector 234 and to mount the shaft receiver on the bottom bar and to still provide for limited pivotal movement by means of suitably mounted stop members. Also instead of two bolts 290 at each end of the bottom bar, it is possible to employ only one bolt 290 which extends through a single slot formed in the bar receiver.

It will be further appreciated by those skilled in the roll-up door art that it is also possible to provide the described bottom bar apparatus with no stop member or stop members for limiting the pivotal movement of the bottom bar, particularly if the roll-up door will not be subject to substantial windloads given its location or area of use, and will not be subject to substantial pressure differentials between the front and the back of the door curtain.

In one embodiment of the roll-up door, the curtain has a thickness of one-quarter inch and is made of corded rubber. It will be appreciated that other forms of curtain material can also be used in the present roll-up door.

An advantage of the pivoting bottom bar apparatus described herein is that because the bottom bar can rotate or pivot without a corresponding rotation of the channel members 154, 156, the apparatus avoids excessive torsional forces being exerted on the guide channel systems 152. With previously known bottom bar designs, excessive torsional forces on the guide systems resulted in premature breakage and/or wear on the bar connectors and the guide channel systems. If the bar connector should break under these excessive forces, the curtain will come out of the curtain guides and possibly damage adjacent equipment and/or hit a person in the vicinity.

The advantage of the stop members which limit the amount of pivotal movement of the bottom bar is that they act as a positive locking mechanism that restricts the amount of sail of the curtain to a predetermined maximum distance that equals the amount of sail allowed in the curtain for normal operation. As the windload increases, the pivoting bottom bar constructions of the present disclosure are able to compensate by pivoting to keep the tensions from the curtain perpendicular to the bottom bar along its strongest axis and this reduces the amount that the bottom bar raises off the floor or ground in the middle of the opening. Because of this reduction, a better seal at the floor can be provided under windload conditions.

While the present invention has been illustrated and described as embodied in various exemplary embodiments, e.g., embodiments having particular utility for roll-up doors having flexible curtains, it is to be understood that the present invention is not limited to the details shown herein, since it will be understood that various omissions, modifications, substitutions and changes in the forms and details of the disclosed bottom bar apparatus and roll-up doors and their operation may be made by those skilled in the art without departing in any way from the spirit and scope of the present invention. For example, those of ordinary skill in the art will readily adapt the present disclosure for various other applications without departing from the spirit or scope of the present invention.

I claim:

1. A roll-up door comprising:

a flexible sheet forming a curtain for closing a doorway having an upper end, a lower end, and two opposite side edges, said sheet having a curtain retention arrangement located along two side edge sections thereof;

a curtain winding mechanism having said upper end attached thereto for raising and lowering said curtain;

a pair of spaced apart elongate guide members in which said edge sections are respectively movable, said side edge sections being respectively engageable with said guide members;

a rigid bottom bar mounted on said lower end of the curtain;

two bar connectors for connecting opposite ends of said bottom bar to the guide members, each bar connector being located horizontally outwardly from a respective one of the ends of the bottom bar and being adapted to move up or down in its respective guide member and to be held therein;

two pivot mechanisms each pivotally joining a respective one of said bar connectors to the adjacent end of the bottom bar, each pivot mechanism including a pivot shaft member having a central pivot axis and a shaft receiver into which said pivot shaft member extends and in which said pivot shaft member can pivot about its central pivot axis relative to the shaft receiver, one of the pivot shaft member and the shaft receiver being connected to a respective one of the bar connectors and the other of the pivot shaft member and the shaft receiver being mounted on the bottom bar; and two stop members each mounted on a respective one of the pivot shaft members for limiting pivotal movement of the respective pivot shaft member relative to its shaft receiver during use of the roll-up door when the curtain is subject to windload or greater air pressure on one side of the curtain compared to the other side of the curtain, wherein each stop member extends into a slot formed in the shaft receiver into which the respective pivot shaft member extends.

2. A roll-up door according to claim 1 wherein each bar connector includes a metal plate for slidably engaging a respective one of the guide members, each stop member is mounted on a respective one of said pivot shaft members on one side of the respective metal plate and a further stop member is mounted on an opposite side of each metal plate, and wherein said shaft receiver is rigidly mounted on or at an inner edge of said metal plate.

3. A roll-up door according to claim 1 wherein each guide member forms an elongate slot in which a respective one of said side edge sections of the curtain is movable upwardly or downwardly and wherein each bar connector includes a metal plate having two connecting stops mounted on opposite sides thereof and each bar connector is held in the elongate slot of a respective one of said guide members by elongate guide stops provided on said guide members.

4. A roll-up door according to claim 3 wherein each connecting stop is an elongate plastics strip bolted to its respective metal plate and said metal plate has two plastic wear pads attached to its two opposite sides to help reduce wear on the guide member and its bar connector.

5. A roll-up door according to claim 1 wherein each stop member is a bolt threaded into an end of its respective pivot shaft member and each slot is formed in an end plate of its shaft receiver.

6. A roll-up door comprising:

a flexible sheet forming a curtain for closing a doorway having an upper end, a lower end, and two opposite side edges, said sheet having a curtain retention arrangement located along two side edge sections thereof;

a curtain winding mechanism having said upper end attached thereto for raising and lowering said curtain;

a pair of spaced apart elongate guide members in which said edge sections are respectively movable, said side edge sections being respectively engageable with said guide members;

a rigid bottom bar mounted on said lower end of the curtain;

two bar connectors for connecting opposite ends of said bottom bar to the guide members, each bar connector being located horizontally outwardly from a respective one of the ends of the bottom bar and being adapted to move up or down in its respective guide member and to be held therein;

two pivot mechanisms each pivotally joining a respective one of said bar connectors to the adjacent end of the bottom bar, each pivot mechanism including a pivot shaft member having a central pivot axis and a shaft receiver into which said pivot shaft member extends and in which said pivot shaft member can pivot about its central pivot axis relative to the shaft receiver, one of the pivot shaft member and the shaft receiver being connected to a respective one of the bar connectors and the other of the pivot shaft member and the shaft receiver being mounted on the bottom bar; and a stop member mounted on one of said pivot mechanisms or one of said bar connectors for limiting pivotal movement of the adjacent pivot shaft relative to its shaft receiver during use of the roll-up door when the curtain is subject to windload or greater air pressure on one side of the curtain compared to the other side of the curtain, wherein said stop member limits the pivotal movement of the adjacent pivot shaft member to about 15 degrees in either direction from a vertical plane defined by the two guide members when the roll-up door is installed in a door opening.

7. A bottom bar apparatus for a roll-up door curtain having an upper end attachable to a curtain winding mechanism, a lower end, and two side edges, said door curtain being mountable at a door opening having two opposite vertical sides, said bottom bar apparatus comprising:

an elongate bottom bar mountable on said lower end of the door curtain so as to extend at least most of the length of said lower end;

two bar connectors for slidably connecting opposite ends of said bottom bar to respective elongate guide members mountable along said opposite vertical sides of the door opening when said door curtain is installed;

two pivot mechanisms each pivotally joining a respective one of said bar connectors to a respective one of said ends of the bottom bar, each pivot mechanism including a pivot shaft having a central pivot axis and a shaft receiver into which the pivot shaft extends, each pivot shaft being pivotal in its shaft receiver about its central pivot axis, one of each pivot shaft and its shaft receiver being directly connected to a respective one of the bar connectors and the other of each pivot shaft and its shaft receiver being directly mounted on the bottom bar; and at least one stop device arranged to limit pivotal movement of the bottom bar, the or each stop device including a stop member mounted on one of the group consisting of its respective pivot mechanism and the adjacent bar connector so as to restrict pivotal movement of its pivot shaft relative to its shaft receiver during use of the roll-up door curtain when the curtain is subject to windload or greater air pressure on one side of the curtain compared to the other side of the curtain.

8. A bottom bar apparatus according to claim 7 wherein there are two of said at least one stop device and the stop member of each stop device is a bolt mounted on a respective one of the pivot mechanisms and extends into a slot formed in the shaft receiver of the respective one pivot mechanism.

9. A bottom bar apparatus according to claim 7 wherein each bar connector comprises a metal plate for slidably engaging a respective one of the guide members and two stop members mounted on opposite sides of the metal plate and wherein each shaft receiver is mounted on a respective one of the metal plates.

10. A bottom bar apparatus according to claim 7 wherein said at least one stop device limits pivotal movement of the pivot shafts to no more than 15 degrees in either direction from a vertical plane extending through an axial centerline of the bottom bar when the roll-up door curtain with the bottom bar is installed and hanging vertically.

11. A bottom bar apparatus according to claim 8 wherein each stop device includes two stop members each formed by a bolt threaded into an outer end of its respective pivot shaft and there are two slots formed in each shaft receiver, one slot for each of the bolts.

12. A bottom bar apparatus for a roll-up door curtain having opposite upper and lower ends and two opposite side edges, said door curtain being mountable in a door opening having two opposite vertical sides along which extend respective elongate door guide units, said bottom bar apparatus comprising:

an elongate bottom bar mountable on said lower end of the door curtain;

two bar connectors for slidably connecting opposite ends of said bottom bar to said guide units, each bar connector including a metal plate and two elongate connector stops mounted on opposite sides of said metal plate and extending in a direction substantially perpendicular to the length of the bottom bar; and two pivot mechanisms each pivotally joining a respective one of said bar connectors to a respective one of said ends of the bottom of a bar, each pivot mechanism including a pivot shaft pivotally connected to one of a group consisting of said bottom bar and a respective one of the bar connectors, and a shaft receiver into which said pivot shaft extends, said shaft receiver being mounted on the other of said group consisting of said bottom bar and a respective one of the bar connectors, wherein each pivot mechanism includes at least one stop device to limit pivotal movement of the bottom bar, the or each stop device including a stop member mounted on the respective pivot shaft and a cooperating slot into which said stop member extends, said slot being formed in the respective shaft receiver.

13. A bottom bar apparatus according to claim 12 wherein said bottom bar is an elongate tube and each pivot shaft is rigidly connected at one end thereof to a mounting plate fixedly attached to an adjacent end of the bottom bar.

14. A bottom bar apparatus according to claim 12 wherein each pivot mechanism had two of said at least one stop member in the form of two bolts threaded into an outer end of their respective pivot shaft and there are two of said cooperating slot, each of the two bolts extending into a respective one of the two slots.

15. A bottom bar apparatus according to claim 12 wherein said at least one stop device limits the pivotal movement of the bottom bar to no more than 15 degrees in either direction from a vertical plane extending through an axial centerline of the bottom bar when the roll-up door curtain with the bottom bar is installed and hanging vertically.

16. A bottom bar apparatus according to claim 12 wherein each pivot mechanism includes a friction reducing ultrahigh molecular weight plastics sleeve extending around the pivot shaft and located within said shaft receiver.

17. A bottom bar apparatus according to claim 12 wherein each shaft receiver is a relatively short, cylindrical tube closed by an end plate at its outer end, said slot being formed in said end plate and said cylindrical tube being rigidly attached to the metal plate of its respective bar connector.

18. A bottom bar apparatus according to claim 12 wherein each connector stop is an elongate stop member made of ultrahigh molecular weight PE and detachably connected to the adjacent metal plate.

19. A bottom bar apparatus according to claim 12 wherein the metal plate of each bar connector is covered on both sides with a wear pad made of ultrahigh molecular weight PE.

* * * * *